US009961424B1

(12) United States Patent
Pittman et al.

(10) Patent No.: US 9,961,424 B1
(45) Date of Patent: May 1, 2018

(54) AUDIO CABINET AND CONTROL PANEL

(71) Applicant: Aspen & Associates, San Fernando, CA (US)

(72) Inventors: Richard Aspen Pittman, Sylmar, CA (US); Marshall David Buck, Los Angeles, CA (US)

(73) Assignee: ASPEN & ASSOCIATES, San Fernando, CA (US)

( * ) Notice: Subject to any disclaimer, the term of this patent is extended or adjusted under 35 U.S.C. 154(b) by 0 days. days.

(21) Appl. No.: 15/409,216

(22) Filed: Jan. 18, 2017

(51) Int. Cl.
*H04R 1/20* (2006.01)
*H04R 1/02* (2006.01)
*H04R 3/04* (2006.01)

(52) U.S. Cl.
CPC ..... *H04R 1/025* (2013.01); *H04R 3/04* (2013.01); *H04R 2201/028* (2013.01); *H04R 2201/029* (2013.01)

(58) Field of Classification Search
CPC ..... H04R 1/025; H04R 2201/028; H04R 2201/029
See application file for complete search history.

(56) References Cited

U.S. PATENT DOCUMENTS

2006/0159291 A1* 7/2006 Fliegler ..... G10H 1/0066 381/118
2008/0085011 A1* 4/2008 Nett ..... H04R 5/02 381/85
2015/0201255 A1* 7/2015 Porter ..... H04R 1/00 381/334

* cited by examiner

*Primary Examiner* — Brian Ensey
(74) *Attorney, Agent, or Firm* — Connors & Assoc. pc; John J. Connors

(57) ABSTRACT

Our audio cabinet includes a recess in a cabinet wall in which is seated a control panel comprising a rigid plate bent to form a first planar section and a second planar section connected together by a slanted planar section. An exposed face surface of the slanted planar section includes at least one socket for inserting a plug of a cable. The rigid plate has a configuration that is complementary to the configuration of a perimeter of the recess so the plate fits within the recess with the exposed face surface facing the one side of the enclosure. With the plate seated in the recess the socket faces the one side of the enclosure and the exposed face of the slanted section is offset a predetermined distance from said one side to provide clearance for the plug to be inserted into the socket. The dimensions of the recess and angles of the plate are arranged such that an inserted plug is protected from contact with the floor if the audio cabinet is toppled over.

12 Claims, 7 Drawing Sheets

AUDIO CABINET AND CONTROL PANEL

INCORPORATION BY REFERENCE

Any and all U.S. patents, U.S. patent applications, and other documents, hard copy or electronic, cited or referred to in this application are incorporated herein by reference and made a part of this application.

DEFINITIONS

The words "comprising," "having," "containing," "holding," and "including," and other grammatical forms thereof, are intended to be equivalent in meaning and be open ended in that an item or items following any one of these words is not meant to be an exhaustive listing of such item or items, nor meant to be limited to only the listed item or items.

The word "cable" includes any flexible and elongated electrically conductive material employing one or multiple strands.

The word "rectangular " includes square.

BACKGROUND

Traditional guitar, bass and keyboard instrument amplifiers almost universally use an audio cabinet housing a speaker and it's electronics. A control panel, mounted on the exterior of the cabinet and facing outwardly, is commonly positioned in a front wall, a rear wall, or a top wall of the cabinet. Protruding from the control panel's exterior surface is an array of input sockets, control knobs or dials, and switches such as a power switch. In all these cases the input sockets, control knobs or dials, and switches are on a straight common line in a flat plane on the control panel. This alignment design for all the input sockets, controls, and switches is most likely chosen to better facilitate manufacture of a simpler PCB (printed circuit board) so all components can be mounted in a sub 'assembly' and thereby reduce time in the assembly process.

While this flat plane design has its obvious cost savings advantages, it does pose one problem that has always plagued the user, namely, the instrument or microphone being connected to the control panel has a cable terminating in an elongated connector (commonly referred to as a plug) that is inserted into an input jack (commonly referred to as a socket) on the control panel. The plug, (for example a ¼" phone plug or Male XLR connector) has a length of no more than about 3 inches, typically its length is at least 2 inches. This plug extends outward at a 90-degree angle with respect to the control panel's planar surface. The instrument cable extending from the plug typically hangs downward along the front wall or rear wall of the cabinet. This is both unsightly and dangerous. If the cabinet housing tips and falls forward, or backwards in the case of a rear control panel, the instrument plug and input socket take the brunt of the fall. Consequently, the instrument plug and/or input socket will bend or break and/or bend the control panel. In either case, this fall forward, or backward, could render the audio equipment unusable until repaired, and/or new cables can be purchased. Additionally, in the case of a top facing control panel, if a heavy object is placed on top of the cabinet the instrument plug and/or input socket will take the brunt of the weight and may be damaged.

SUMMARY

Our audio cabinet and control panel has one or more of the features depicted in the embodiments discussed in the section entitled "DETAILED DESCRIPTION OF SOME ILLUSTRATIVE EMBODIMENTS." These features are not listed in any rank order nor is this list intended to be exhaustive. The claims that follow define our audio cabinet and control panel, distinguishing them from the prior art; however, without limiting the scope of our audio cabinet and control panel as expressed by these claims, in general terms, some, but not necessarily all, of their features are:

One, our control panel has a unique configuration to be mounted to a wall of an enclosure for audio equipment so that upon plugging a plug at a terminal end of an instrument cable into the control panel the input socket is seated within a recess that protects the socket and plug against damage if the enclosure is tipped over. Moreover, the input socket is oriented so a cable extending from the socket is directed to a side of the enclosure. In one embodiment the entire plug is housed within a depression that provides clearance for the plug upon insertion into the socket so that the plug is inward of an exterior face surface of the wall. The dimensions of the depression result in a low profile of the plug projecting from the slanted wall upon insertion into the socket so that no portion of the plug projects outward beyond the wall.

Two, our control panel comprises a rigid plate having opposed ends and opposed side edges, a longitudinal centerline. Typically, the plate has a thickness from 0.010 inch to 0.250 inch, and a rectangular shape having a length from 5 to 24 inches, and a width from 1 to 10 inches.

Three, the control panel plate is bent along intermediate spaced apart bend lines that are at a right angle to the longitudinal center line and are between the opposed ends of the plate. Bending the plate forms the plate into a first planar section and a second planar section connected together by a slanted planar section. The slanted planar section has an exposed face surface including at least one socket for a plug of a cable.

Four, the first and second planar sections are in parallel planes that are offset with respect to each other by a distance no greater than 3 inches. The parallel bend lines are separated by a distance from 1 to 4 inches. An inner edge of the second planar section terminates at one of the bend lines and an outer edge of the second planar section is at least 0.50 inch from the one bend line.

Five, the slanted planar section is at an angle from 15 to 85 degrees with respect to the second planar section.

Six, our audio cabinet includes an enclosure having opposed right and left sides and between the sides a wall. Our control panel is designed to sit within a recess in the wall between the sides, either a top wall, a front wall, or a rear wall, or a sidewall. The rigid plate of our control panel has a configuration that is complementary to the configuration of the perimeter of the recess so that the plate fits within the recess with the exposed face surface facing one side of the enclosure. The first and second planar sections are in parallel planes that are offset with respect to each other by a distance no greater than a predetermined depth of the recess. The second planar section has an outer edge near one side of the enclosure and an inner edge that lays along one of the bend lines that is adjacent the second planar section. With the plate seated in the recess the socket faces the one side of the enclosure and the exposed face of the slanted section is offset a predetermined distance from the one side to provide clearance for the plug to be inserted into the socket.

Seven, the recess is formed by a frame structure having a configuration that is complementary to the configuration of the perimeter of the control panel. This enables the control panel to be attached to the frame structure and seated within the recess. The plate may have edges that are fastened to the frame structure.

DESCRIPTION OF THE DRAWING

Some embodiments of our audio enclosure and control panel are discussed in detail in connection with the accompanying drawing, which is for illustrative purposes only. This drawing includes the following figures (Figs.), with like numerals and letters indicating like parts:

- FIG. 1A is a schematic plan view of a typical prior art control panel;
- FIG. 3C is a perspective view of a typical prior art amplifier with its control panel upward facing in a top wall of the amplifier's cabinet.
- FIG. 1 is a schematic plan view of one embodiment of our control panel showing the exterior of the panel.
- FIG. 2 is a schematic side view of the panel shown in FIG. 1 and inverted with the exterior of the panel facing downward.
- FIG. 3 is a perspective view of one embodiment of audio equipment using our panel, with sections broken away to show a speaker within an enclosure.

DETAILED DESCRIPTION OF ONE ILLUSTRATIVE EMBODIMENT

FIGS. 1A through 3C

Figure 1:
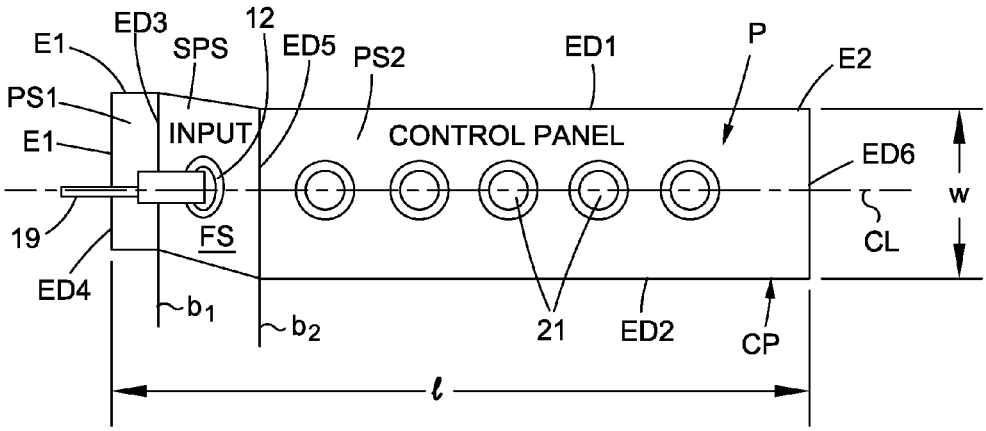
- FIGS. 1A through 3C depict prior art audio equipment where

FIGS. 1A through 3C depict typical prior art audio equipment employing a control panel 10 where a socket 12 for a male plug 18 is mounted to the underside of the control panel 10 near an end of the panel. The socket 12 is a female receptacle 12*a* having its longitudinal central line 12*b* at a right angle to a flat planar underside surface 16*a* of the control panel 10. The plug 18 is configured to be received within the female receptacle 12*a* and this plug establishes an electrical connection between the instrument and the audio equipment upon insertion into the female receptacle 12*a*.

The plug 18 has a rigid shaft 18*a* of a length of from 1 to 3 inches that has one terminal end Ea attached to a cable 19. The other terminal end Eb of the cable 19 is connected to another plug 18 for connecting to a keyboard, microphone, guitar, or other electrical instrument (not shown). As depicted in FIG. 3A, this cable 19 usually hangs downward overlying a front wall of a cabinet 20 for electronic equipment instead of off to the side of the cabinet 20; this is an unsightly and unsafe condition.

Figure 2:
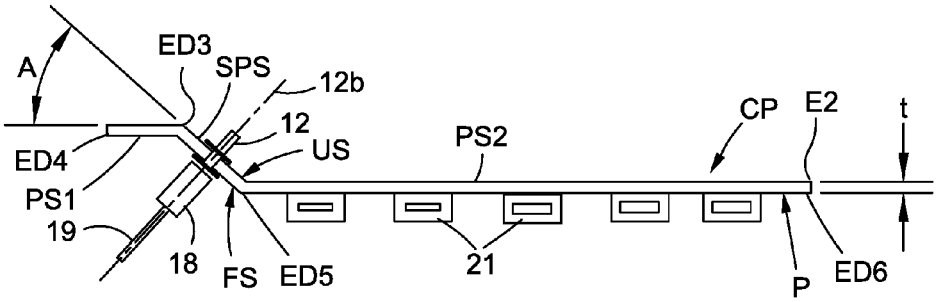
Figure 1A:
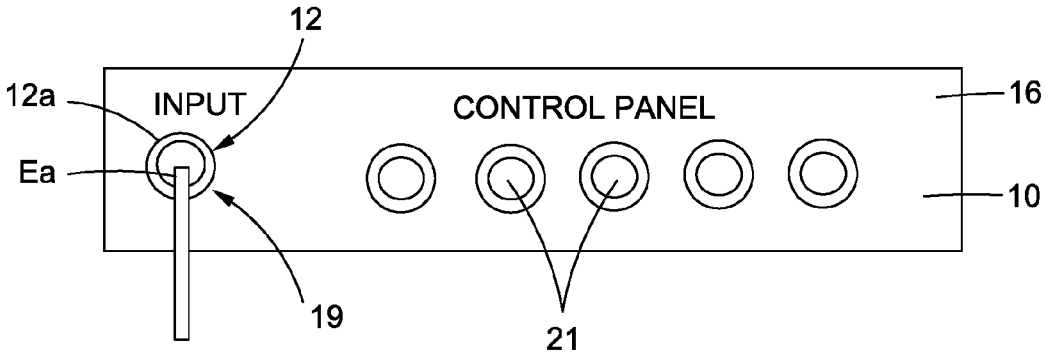
Fig. 1A (PRIOR ART)
Figure 2A:
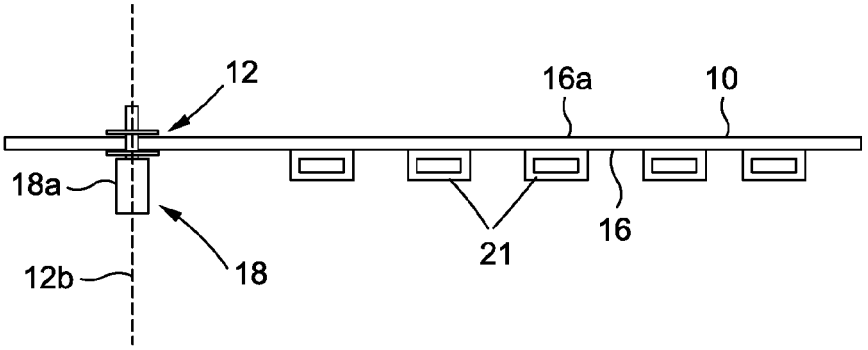
Fig. 2A (PRIOR ART)
- FIG. 2A is a schematic side view of the prior art control panel shown in FIG. 1A and inverted.

As best illustrated in FIG. 2A, with the socket 12 mounted in this fashion, upon inserting the plug 18 into the socket 12 the plug projects at a right angle outward from a flat planar exterior surface 16 of the control panel. Usually additional control dials 21 are mounted on the flat planar exterior surface 16 of the control panel 10 for controlling volume, gain, treble, middle bass, reverb, etc. In this position of the plug's 18 orientation relative to the exterior surface 16, the result is an attached cord 19 drooping down due to gravity and lying against the speaker's screen cover 20*b*. This is the unsafe and unsightly objectionable condition that our control panel solves.

Figure 3:
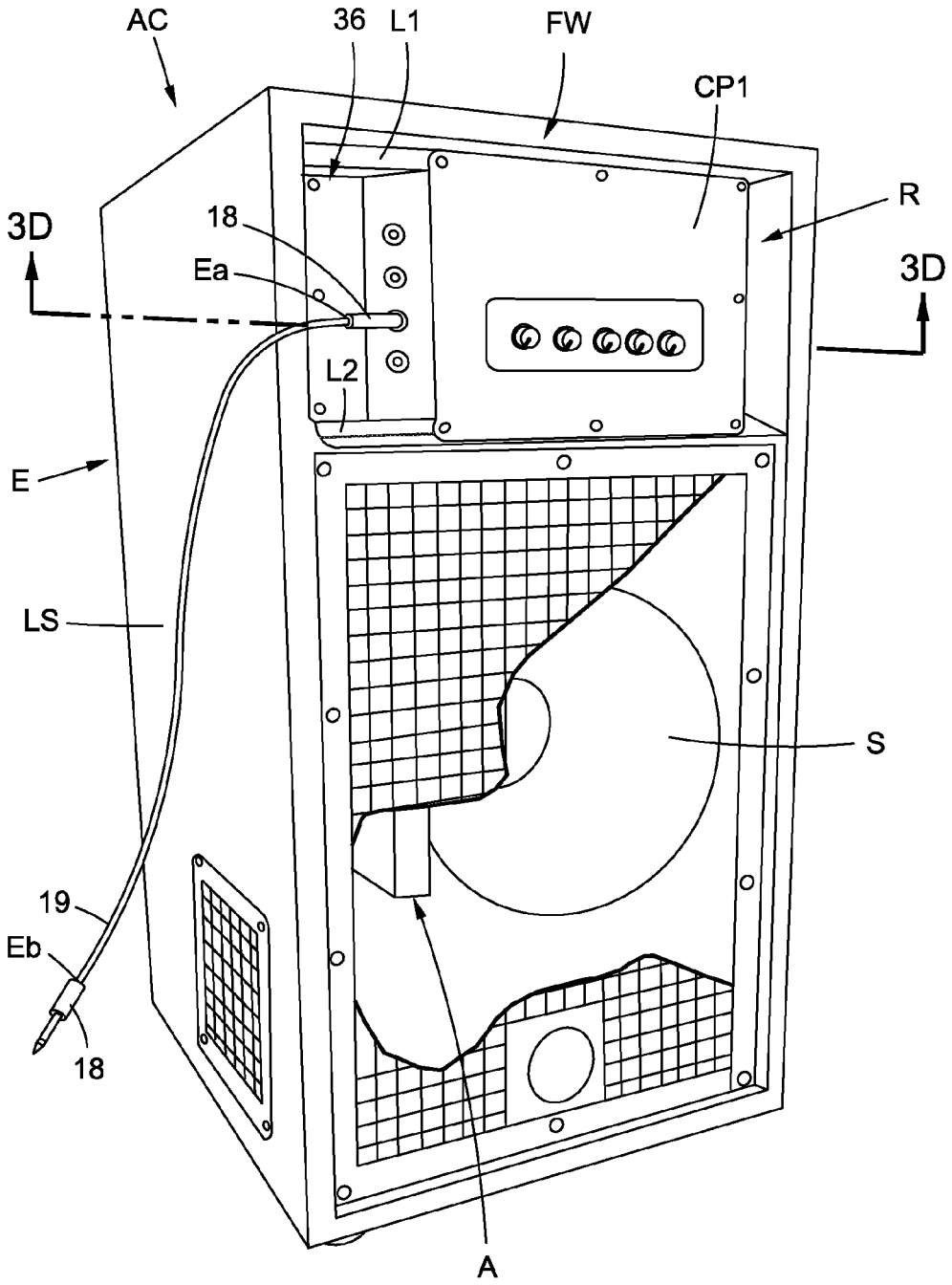
Figure 3A:
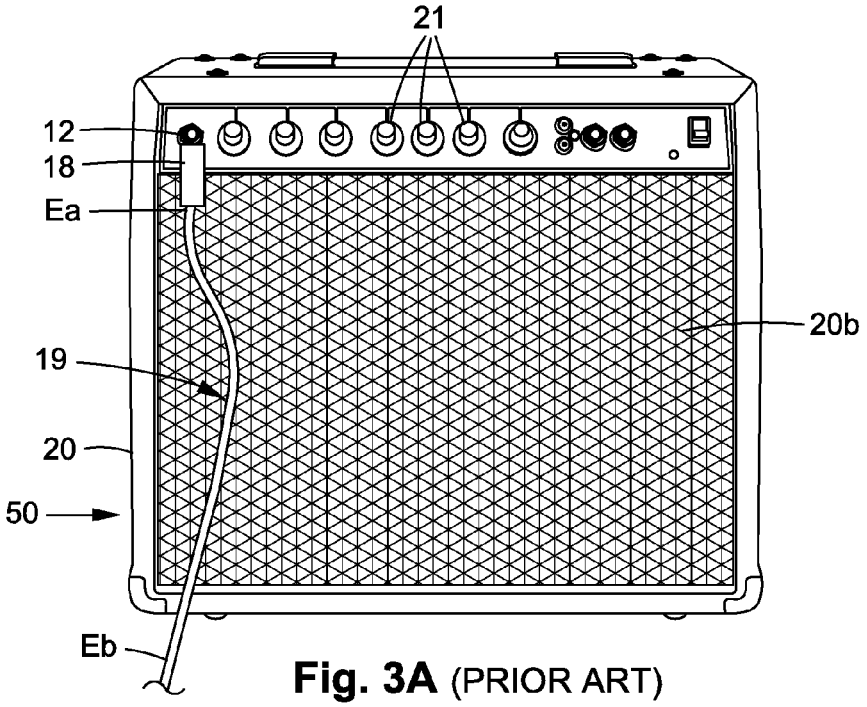
Fig. 3A (PRIOR ART)
- FIG. 3A is a perspective view of a typical prior art combo amplifier-speaker with its control panel in an upper portion of a front wall of the amplifier-speaker's cabinet.
Figure 3B:
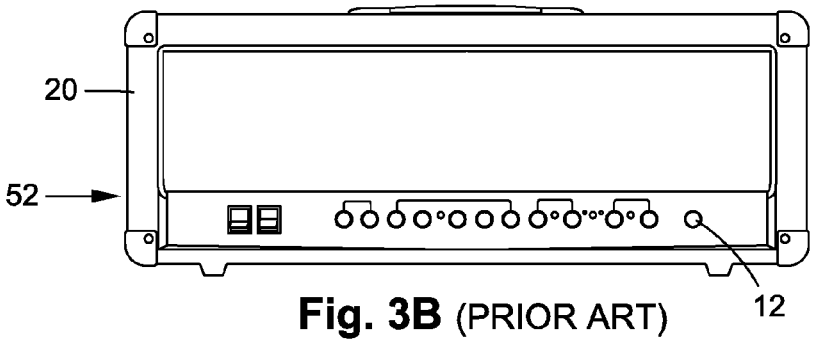
Fig. 3B (PRIOR ART)
- FIG. 3B is a front view of a typical prior art amplifier only with its control panel in a lower portion of a front wall of the amplifier's cabinet.
Figure 3C:
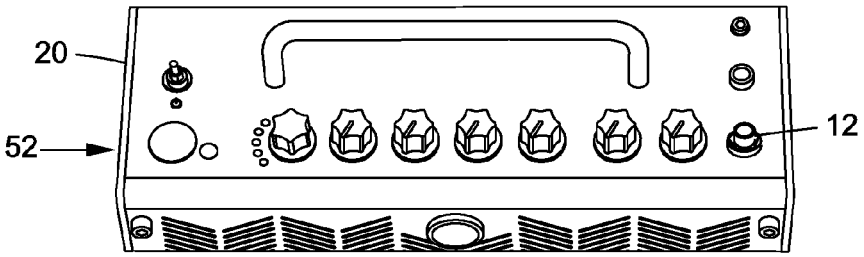
Fig. 3C (PRIOR ART)

As illustrated in FIGS. 3A-3C all these versions of typical prior art cabinets 20 provide a box-type enclosure with the electronic equipment within the enclosure accessed through the control panel 10 located in a wall of cabinet 20. FIG. 3A illustrates a typical prior art combo amplifier-speaker 50 with its control panel 10 in an upper portion of a front wall of the amplifier-speaker's cabinet 20. FIG. 3B illustrates a typical prior art amplifier 52 without a speaker with its control panel 10 in a lower portion of a front wall of the amplifier's cabinet 20. FIG. 3C illustrates a typical prior art amplifier 54 with its control panel 10 upward facing in a top wall of the amplifier's cabinet 20.

FIGS. 1 and 2

As shown in FIGS. 1 and 2, our control panel CP comprises a rigid plate P made from a metal bent into a predetermined shape as subsequently discussed. This plate P may have a rectangular configuration having opposed ends E1 and E2 and opposed side edges ED1 and ED2, a longitudinal center line CL, a thickness t from 0.010 to 0.250 inch, a length l from 5 to 24 inches, and a width w from 1 to 10 inches. Near the end E1 the plate P is bent along a pair of intermediate spaced apart bend lines $b_1$ and $b_2$ that are at a right angle to the longitudinal center line CL and are between the opposed ends E1 and E2 of the plate. Bending the plate P in this manner forms a first planar section PS1 and a second planar section PS2 connected together by a slanted planar section SPS. Upon assembling the plate P and an enclosure E (FIG. 3) as subsequently discussed, the plate P is oriented so the slanted planar section SPS has a flat exposed or exterior face surface FS facing outward and a flat unexposed interior or underside surface US (FIG. 2). At least one socket 12 for a plug 18 of a cable 19 is mounted to the underside US slanted planar section SPS. The socket's longitudinal central line 12*b* (FIG. 2) is at a right angle to the underside surface US.

The first planar section PS1 and second planar section PS2 are in parallel planes that are offset with respect to each other by a distance no greater than 3 inches. The parallel bend lines $b_1$ and $b_2$ are separated by a distance from 1 to 4 inches with an inner edge ED3 of the first planar section PS1 terminating at the bend line $b_1$ and an outer edge ED4 of the first planar section PS1 being at least 1 inch from the one bend line $b_1$, typically from 2 to 4 inches. An inner edge ED5 of the second planar section PS2 terminates at the bend line $b_2$ and an outer edge ED6 of this second planar section PS2 being at least 0.50 inch from the one bend line $b_2$, typically from 1 to 3 inches. The flat exposed face surface FS and unexposed flat underside surface US of the slanted planar section SPS are in parallel and each at an angle A from 15 to 85 degrees with respect to the second planar section PS2.

As a consequence of this configuration of our control panel CP, the panel may be seated in a recess R in a front wall (FIGS. 3 through 7), a rear wall (not shown), a side wall (not shown), or a top wall (not shown) of an audio cabinet in a manner that avoids the unsightly and dangerous problem associated with prior art control panels. Upon assembling the plate P and an enclosure E (FIG. 3), as subsequently discussed, the plate P is oriented so the slanted planar section SPS has a flat exposed or exterior face surface FS facing outward and a flat unexposed interior or underside surface US (FIG. 2).

FIGS. 3 through 8

As depicted in FIGS. 3 through 7 our audio cabinet AC includes an enclosure E having opposed right side RS and left side LS, and between these sides is a front wall FW. In this embodiment our control panel CP1 is assembled with an enclosure E that houses within it a speaker S and an amplifier A. This enclosure E is a box-type structure made in a conventional manner from rigid materials such as flat wooden panels WP and elongated wooden elements WE fastened together using glue, nails, screws, staples etc., generally identified by the numeral 30, with openings O as appropriate for sound to emanate from one or more speakers within the enclosure E.

Figure 3D:
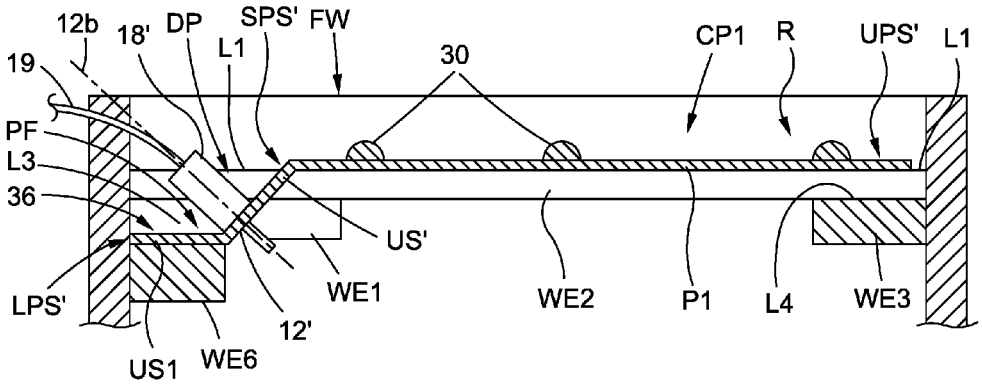
- FIG. 3D is a cross-sectional view taken along the line 3D-3D of FIG. 3.
Figure 3E:
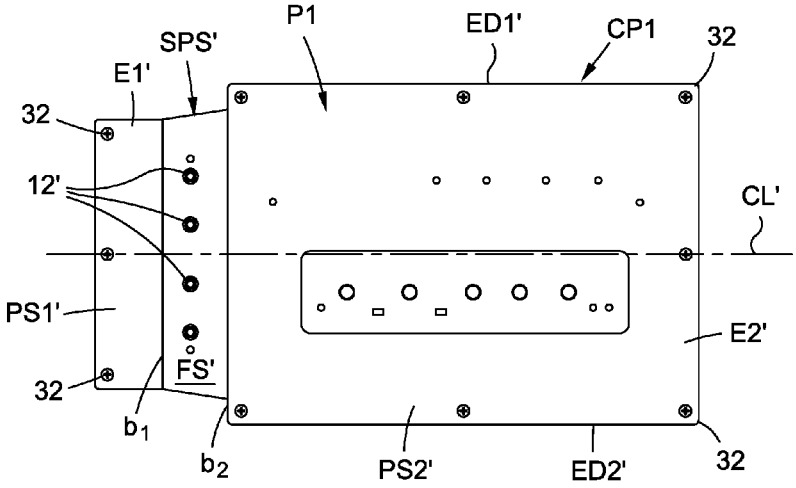
- FIG. 3E is a plan view of another embodiment of our control panel employing a plurality of sockets and used in the audio equipment depicted in FIG. 3.
Figure 4:
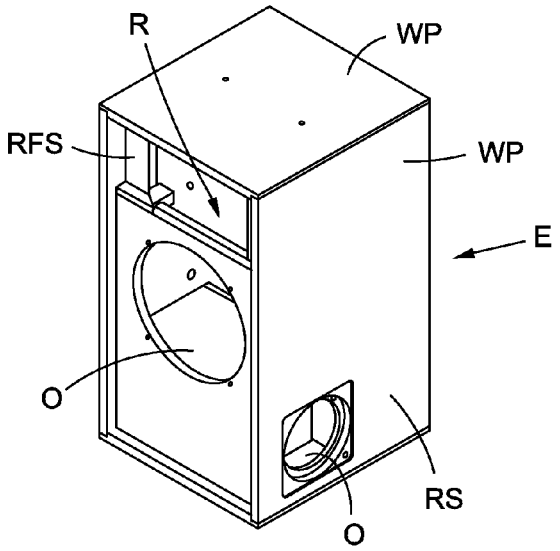
- FIG. 4 is a perspective view of one embodiment of an enclosure used with the embodiment depicted in FIG. 3 with the amplifier, speaker and our control panel removed.
Figure 5:
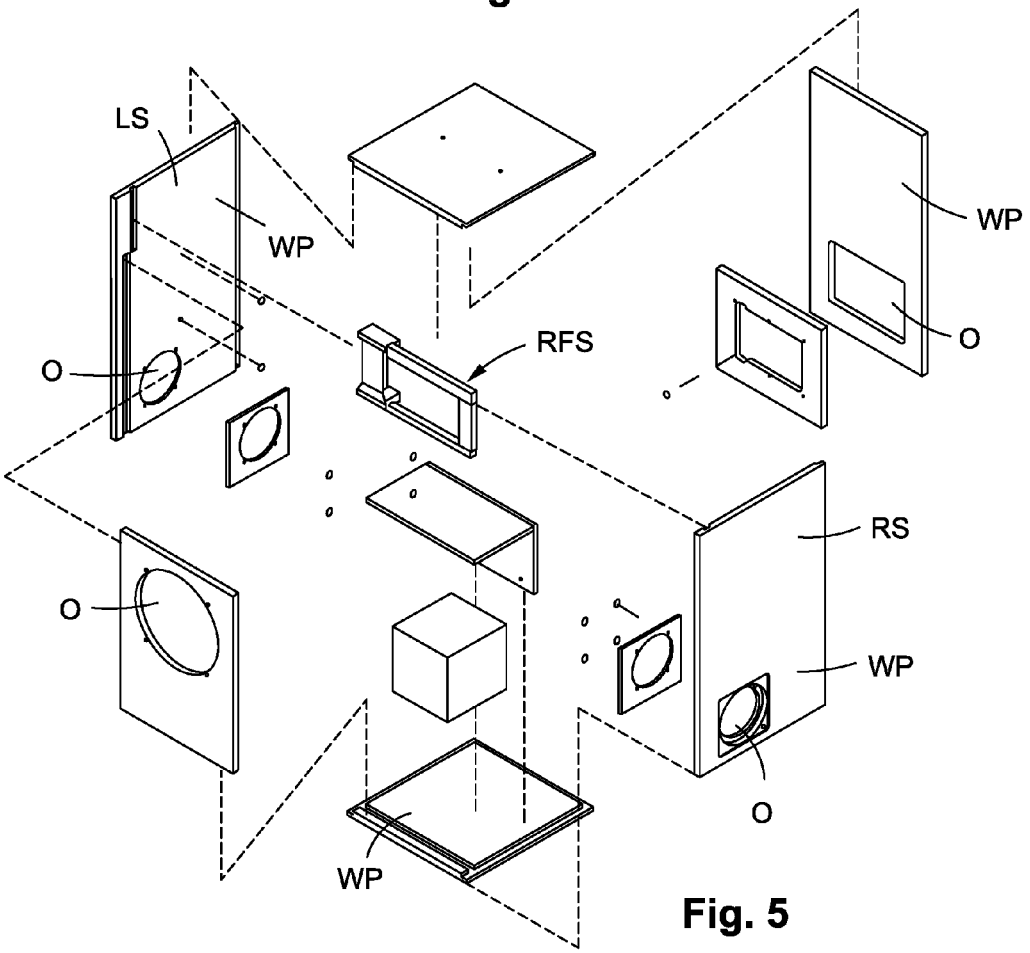
- FIG. 5 is an exploded perspective view of the enclosure shown in FIG. 4.

The embodiment of our control panel CP1 illustrated in FIGS. 3, 3D and 3E is similar to our control panel CP shown in FIGS. 1 and 2. Unlike our control panel CP our control panel CP1 has larger dimensions; nevertheless, its dimensions are still within the ranges discussed above in connection our panel CP. The one difference is that our control panel CP1 uses a plurality of sockets 12' essentially identical to those previously discussed but aligned in a straight row in a flat exposed exterior face surface FS' of the control panel CP1. The straight row of sockets 12' are configured at a right angle to a centerline CL' of the plate P1. Another difference is that the end E1', including the first planar section PS1', and the slanted planar section SPS', of the plate P1 are tapered inward slightly.

As best illustrated in FIG. 3, our control panel CP1 is seated in the front wall FW in a recess R. This recess R is formed by a frame structure RFS having a configuration complementary to the configuration of the perimeter of the control panel CP1 to enable the control panel CP1 to be attached to the frame structure RFS and seated within the recess R. In this case the frame structure RFS is rectangular so the recess R has a rectangular perimeter with dimensions only slightly greater than the dimensions of the control panel CP1.

As best illustrated in FIG. 3D the rigid plate P1 is bent to provide a platform PF inward a predetermined distance from the front wall FW. The platform PF is nearby the left side LS and includes the slanted planar section SPS' displaced from the left side LS a predetermined distance and slanting away from the left side LS. The predetermined distances form a depression DP in which the plug 18' is housed that provides clearance for the plug 18' upon insertion into the socket 12' so that the plug is inward of an exterior face surface of the front wall FW. The depression has dimensions resulting in a low profile of the inserted plug 18' projecting from slanted planar section SPS'. Consequently, upon insertion of the plug 18' into the depression DP, as the plug is inserted into the socket 12', the plug clears the interior surfaces so that no portion of the plug 18' projects outward beyond the front wall FW of the enclosure E. Typically, the depression DP has a depth from 1 to 4 inches.

Figure 6:
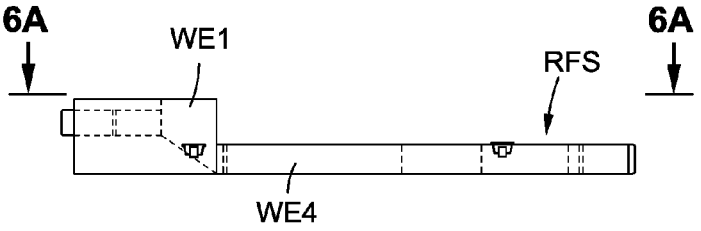
- FIG. 6 is a side view of a frame structure that retains our control panel within the enclosure shown in FIG. 4.
Figure 6A:
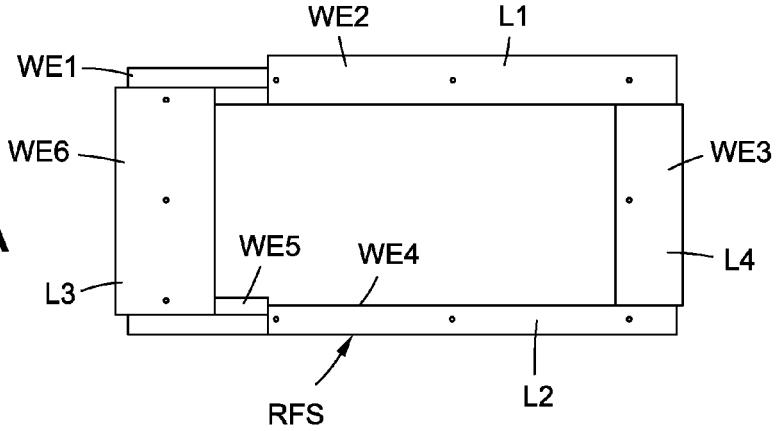
- FIG. 6A is a plan view of the frame structure taken along line 6A-6A of FIG. 6.
Figure 7:
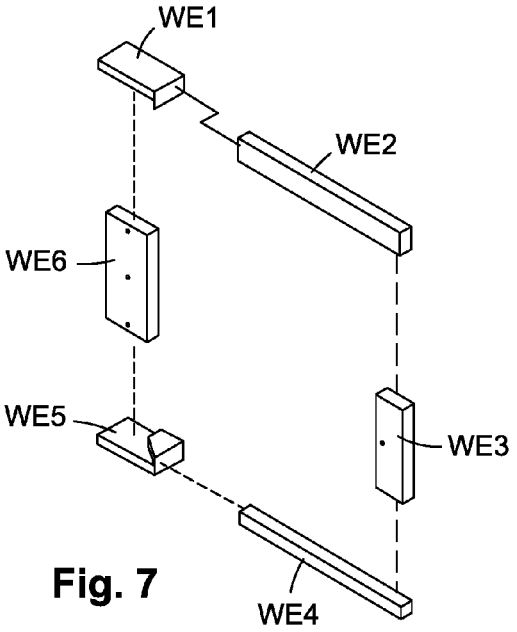
- FIG. 7 is an exploded perspective view of the frame structure shown in FIGS. 6 and 6A.

As shown in FIGS. 6, 6A and 7, the frame structure RFS comprises the elongated, mainly straight, wooden elements WE1 through WE6 glued or otherwise fastened together to provide a first pair of opposed sunken ledges L1 and L2 and a second pair of opposed sunken ledges L3 and L4. The assembled wooden elements WE1 through WE6 form a step 36 in the frame structure RFS, and the underside surfaces of the opposed edges ED1' and ED2' of the plate P1 rest on the ledges L1 and L2, respectively, and the underside surfaces of the opposed ends E1' and E2' of the plate P1 rest on the ledges L3 and L4, respectively. The step 36 is configured to accommodate the tapered end E1' of the first planar section PS1', and the slanted planar section SPS', and an underside surface US1 of the first planar section PS1' contacts the step 36. Along the edges ED1' and ED2' and the ends E1' and E2' are holes 32 for screws 30 that fasten the plate P1 to the ledges L1 and L2. The plate P1 of our control panel CP1 fits between the opposed right side RS and left side LS of the enclosure E and within the recess R, with the exposed face surface FS' facing outward and positioned above the speaker.

The first planar section PS1' and second planar section PS2' are angled offset with respect to each other by a predetermined distance adequate to lower the profile of the plug 18' so it does not project beyond a wall of the audio cabinet AC. In other words, with the plate P1 seated in the recess R, the sockets 12' face the left side LS of the enclosure E and the exposed face surface FS' of the slanted planar section SPS' is offset a predetermined distance from one side, in this case the left side as viewed in FIG. 3, to provide clearance for the plug 18' to be inserted into the socket 12' while the plug 18' is below the exterior face surface FS of the audio cabinet AC. The plate P1 thus overlaps at least partially the wooden elements WE1 through WE6 forming the frame structure RFS.

In an alternate embodiment the plate P1 may be rotated horizontally and configured so the first planar section PS1' and sockets 12' face the right side RS of the enclosure E and the second planar section PS2' is on the left side LS of the enclosure E. Also a control panel with a length of 19 inches is particularly useful. A 19-inch rack is a standardized frame or enclosure used to mount electronic equipment between two rails. Our control panel with a 19-inch length is thus suited as a front faceplate for use with rack mounted electronic equipment; wherein, the opposed ends of our control panel mount to an individual rail of a 19-inch rack.

SCOPE OF THE INVENTION

The above presents a description of the best mode we contemplate of carrying out our audio cabinet and control panel and of the manner and process of making and using them in such full, clear, concise, and exact terms as to enable a person skilled in the art to make and use. Our audio cabinet and control panel is, however, susceptible to modifications and alternate constructions from the illustrative embodiments discussed above which are fully equivalent. Consequently, it is not the intention to limit our audio cabinet and control panel to the particular embodiments disclosed. On the contrary, our intention is to cover all modifications and alternate constructions coming within the spirit and scope of our audio cabinet and control panel as generally expressed by the following claims, which particularly point out and distinctly claim the subject matter of our invention:

The invention claimed is:

1. An audio cabinet including an enclosure having opposed right and left sides and between said sides a wall, a recess in the wall in which is seated a control panel having a perimeter with a predetermined configuration, said control panel comprising a rigid plate bent at an end of the plate to form a first planar section and a second planar section connected together by a slanted planar section, said slanted planar section having an exposed face surface including at least one socket for a plug of a cable, said rigid plate having a configuration that is complementary to the configuration of the perimeter of the recess so that the plate fits within the recess with the exposed face surface facing one side of the enclosure, said first and second planar sections being in parallel planes that are offset with respect to each other by a distance no greater than a predetermined depth of the recess, and said slanted section being formed between a pair of parallel bend lines and slanted at an angle from 15 to 85 degrees with respect to the second planar section, said second planar section having an outer edge near said one side of the enclosure and an inner edge that lies along one of said bend lines that is adjacent the second planar section, and with the plate seated in the recess said socket facing said one side of the enclosure and the exposed face of the slanted section offset a predetermined distance from said one side to provide clearance for the plug to be inserted into the socket.

2. The audio cabinet of claim 1 where said first planar section has an outer edge near the other of the opposed sides of the enclosure and an inner edge that lies along the other of said bend lines that is adjacent first planar section.

3. The audio cabinet of claim 1 where said recess formed by a frame structure has a configuration complementary to the configuration of the perimeter of the control panel to enable the control panel to be attached to the frame structure and seated within the recess.

4. The audio cabinet of claim 3 where the plate has edges that are fastened to the frame structure.

5. An audio cabinet including an enclosure having opposed right and left sides and between said sides a wall, and a control panel seated in a recess in the wall, said control panel comprising a rigid plate bent at an end of the plate to form a platform inward a predetermined distance from the wall, said platform being nearby one of said sides and including a section displaced from said one side a predetermined distance and slanting away from said one side, said slanted section including a socket for a plug to be plugged into the socket, said predetermined distances forming a depression in which the plug is housed that provides clearance for the plug upon insertion into the socket so that the inserted plug is inward of an exterior face surface of the wall.

6. The audio cabinet of claim 5 where said depression has dimensions resulting in a low profile of an inserted plug so that no portion of the inserted plug projects outward from said wall.

7. Audio equipment comprising an amplifier and speaker within a cabinet including an enclosure having opposed right and left sides and between said sides a wall, a recess in the wall in which is seated a control panel having a perimeter with a predetermined configuration, said control panel comprising a rigid plate bent at an end of the plate to form a first planar section and a second planar section connected together by a slanted planar section, said slanted planar section having an exposed face surface including at least one socket for a plug of a cable, said rigid plate having a configuration that is complementary to the configuration of the perimeter of the recess so that the plate fits within the recess with the exposed face surface facing one side of the enclosure, said first and second planar sections being in parallel planes that are offset with respect to each other by a distance no greater than a predetermined depth of the recess, and said slanted section being formed between a pair of parallel bend lines and slanted at an angle from 15 to 85 degrees with respect to the second planar section, said second planar section having an outer edge near said one side of the enclosure and an inner edge that lies along one of said bend lines that is adjacent the second planar section, said first planar section having an outer edge near the other of the opposed sides of the enclosure and an inner edge that lies along the other of said bend lines that is adjacent first planar section, said recess formed by a frame structure having a configuration complementary to the configuration of the perimeter of the control panel to enable the control panel to be attached to the frame structure and seated within the recess, and with the plate seated in the recess said socket facing said one side of the enclosure and the exposed face of the slanted section offset a predetermined distance from said one side to provide clearance for the plug to be inserted into the socket, no portion of an inserted plug projecting beyond said wall.

8. The audio equipment of claim 7 where the plate has edges that are fastened to the frame structure.

9. The audio equipment of claim 7 where including a plurality of sockets aligned in a straight row in the exposed face surface of the slanted section.

10. The audio equipment of claim 7 where the recess and plate have a rectangular shape.

11. A control panel for audio equipment comprising a rigid plate having opposed ends and opposed side edges, a longitudinal center line, a thickness from 0.010 to 0.250 inch, and a rectangular shape having a length from 5 to 24 inches and a width from 1 to 10 inches, said plate bent along intermediate spaced apart bend lines that are at a right angle the longitudinal center line and are between said opposed ends of the plate to form a first planar section and a second planar section connected together by a slanted planar section, said slanted planar section having an exposed face surface including at least one socket for a plug of a cable, said first and second planar sections being in parallel planes that are offset with respect to each other by a distance no greater than 4 inches, and said parallel bend lines being separated by a distance from 1 to 4 inches with an inner edge of the second planar section terminating at one of the bend lines and an outer edge of said second planar section being at least 0.50 inch from said one bend line, said slanted section being at an angle from 15 to 85 degrees with respect to the second planar section.

12. The control panel of claim 11 where said plate has a length of 19 inches.

* * * * *